US005343980A

United States Patent [19]

Elfanbaum

[11] Patent Number: 5,343,980

[45] Date of Patent: Sep. 6, 1994

[54] CHILD/PARENT PLAY LADDER

[76] Inventor: Shlomo Elfanbaum, P.O. Box 579, Doar Kfar Vitkin, 40201, Beit Herut, Israel

[21] Appl. No.: 120,491

[22] Filed: Sep. 14, 1993

Related U.S. Application Data

[63] Continuation of Ser. No. 970,890, Nov. 3, 1992, abandoned.

[30] Foreign Application Priority Data

Nov. 22, 1990 [IL] Israel ..... 96440

[51] Int. Cl.[5] ..... E06C 1/52

[52] U.S. Cl. ..... 182/199; 182/206; 182/194; 482/36; 472/133

[58] Field of Search ..... 182/190, 196–199, 182/194, 206; 482/36, 37; 472/133

[56] References Cited

U.S. PATENT DOCUMENTS

| | | | |
|---|---|---|---|
| 2,927,329 | 3/1960 | Johannis | 182/196 |
| 3,817,351 | 6/1974 | Mikkelson | 182/190 |
| 3,961,686 | 6/1916 | Starkey | 182/196 |
| 4,308,622 | 9/1980 | Maddron | 2/79 |
| 4,596,053 | 6/1986 | Cohen | 2/1 |

*Primary Examiner*—Chin-Shuei Alvin C.
*Attorney, Agent, or Firm*—Mark M. Friedman

[57] ABSTRACT

A ladder which makes it possible for one person to climb onto another, particularly, a ladder which can be worn by an adult for the purpose of enabling a child to climb up the ladder and onto the adult. The top portion of the ladder is attached to a harness facilitates the wearing of the ladder by an adult. The bottom portion of the ladder is attached to a trap which can be stepped on by the adult to stabilize the ladder and prevent it from swinging. In an alternative embodiment the device is in the form of an overcoat featuring a series of holes into which the child can place his feet to facilitate his climbing.

12 Claims, 2 Drawing Sheets

CHILD/PARENT PLAY LADDER

This is a continuation application of U.S. patent application Ser. No. 07/970,890, filed Nov. 3, 1992, abandoned.

FIELD AND BACKGROUND OF THE INVENTION

The present invention relates to a ladder which makes it possible for one person to climb onto another and, more particularly, to a ladder which can be worn by an adult for the purpose of enabling a child to climb up the ladder and onto the adult.

Ladders of many types, including flexible ladders which can be attached at the top to object, such as a window ledge for uses such as a fire escape, are known. Exemplary of such devices are embodiments disclosed in U.S. Pat. Nos. 471,329 and 511,896.

Similarly, a wide variety of devices are known which worn by, or attached to the body of, an adult for the carrying of another person, typically a child. Exemplary of such devices are embodiments disclosed in U.S. Pat. Nos. 2,409,331, 2,846,699, 3,254,815, 4,450,991, and 4,915,991.

It has heretofore been unknown to provide a ladder-like device which can be worn by or attached to the body of one person, typically an adult, to facilitate the climbing onto the ladder-like device, of a second person, typically a small child.

SUMMARY OF THE INVENTION

According to the present invention there is provided a method by which a first person climbs onto a second person, comprising the steps of: (a) attaching a climbing device to the second person; and (b) climbing by the first person using the climbing device, the device including: (i) a ladder; and (ii) attaching means connected to the ladder for attaching the ladder to the second person.

Also according to the present invention there is provided a method by which a first person climbs onto a second person, comprising the steps of: (a) attaching a climbing device to the second person; and (b) climbing by the first person using the climbing device, the device including: (i) a stepping means for accommodating the feet of the first person as the first person climbs onto the second person; and (ii) attachment means for attaching the stepping means to the second person.

According to further features in preferred embodiments of the invention described below, the ladder features at least two rungs and at least two vertical members connection the rungs, which can independently be made of plastic, rope, cloth, fabric, metal or wood.

According to still further features in the described preferred embodiments the top of the ladder can be attached to the person's neck, shoulders, arms, and/or back while the bottom of the ladder can be attached to his foot or leg. Any of these attachments may be adjustable to accommodate persons of differing physical properties, such as height.

The present invention successfully combines the concept of attaching a ladder onto a body to be climbed with the concept of one person carrying a second person to achieve an unexpected and surprising result—namely, an entertaining and valuable device which is useful for the development of motor skills and which is psychologically gratifying for both users.

The device according to the present invention may be used to facilitate the climbing of one person onto another, for example, where an adult who is unable, for medical reasons, to bend down to pick up a child. Use of the device will make it possible for the child to climb up to the adult without the adult's having to bend. Once the child arrives at the adult's arm level the adult may be able to hold the child and carry him around.

It is envisioned that the more important use of the device according to the present invention is as an entertaining contraption for use in play between an adult and a child. The device according to the present invention enables one person, the child, to climb on another person, the adult. The benefits of this are twofold.

First, the physical exertion of climbing builds up the climber's motorial skills and strength, in the same way that slides and similar playground equipment are useful in augmenting the child's motor coordination, strength and fitness, and may, incidentally, also provide desirable exercise for the adult.

Second, and equally important, use of the device according to the present invention serves to strengthen the psychological relationship between the two users. The process of climbing necessarily involves physical contact, and thus the users, typically a parent and child, would get a chance to playfully hug and touch each other.

Thus, use of a device according to the present invention can yield two important and highly beneficial results, enabling parents to boost both their children's physical and psychological well being through the use of a single, simple and inexpensive instrument.

In use, the top portion of the ladder, which may be rigid, but is preferably flexible, is attached to the adult's neck, shoulders, arms, and/or back. The bottom portion is preferably attached to the parent's foot or leg. The child can climb the ladder up to approximately the adult's shoulder level. The child may then hug the adult and, when and if desired, descend to the ground using the ladder. The adult can assist the child in climbing or descending by offering his hands to the child, and/or by tilting his body so as to facilitate the child's movements. The attachment of the upper portion of the ladder can be designed to be adjustable and can be such that the weight of the climbing child is comfortably distributed to reduce the strain on the adult.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a ladder which can be attached to a person in order to enable another person to climb the ladder. Specifically, the present invention can be used to permit a child to climb a ladder which is attached to, or worn by, an adult.

A device according to the present invention includes a ladder which can be harnessed to an adult's body, typically to the adult's neck, shoulders, arms and/or back. Once in place on the adult, the ladder can be climbed by a child up to the adult's shoulder level. The child may stay at that level, he may hug the adult, and he may descend from that level using the ladder. The adult may help the child by offering him his hands, or by tilting his body to facilitate the child's climb or descent.

The set of harnesses which attach the ladder to the adult's body, as well as the attitude of the adult's body, help distribute the child's weight and the burden of his climbing motions throughout the adult's body.

The principles and operation of a device according to the present invention may be better appreciated with reference to the drawings.

Figure 1:
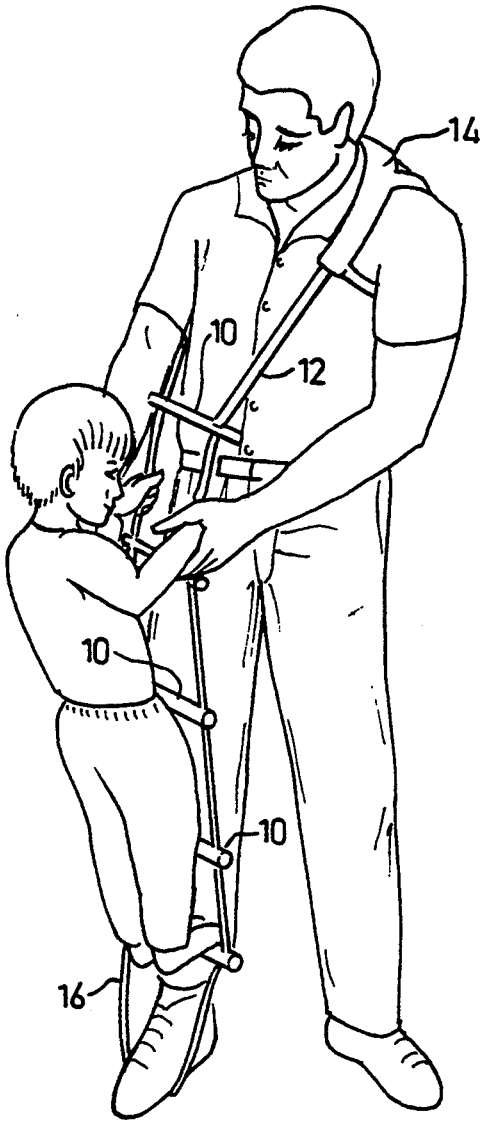
FIG. 1 is a substantially frontal view of an adult wearing a device according to the present invention with a child standing on the lowest rung.
Figure 2:
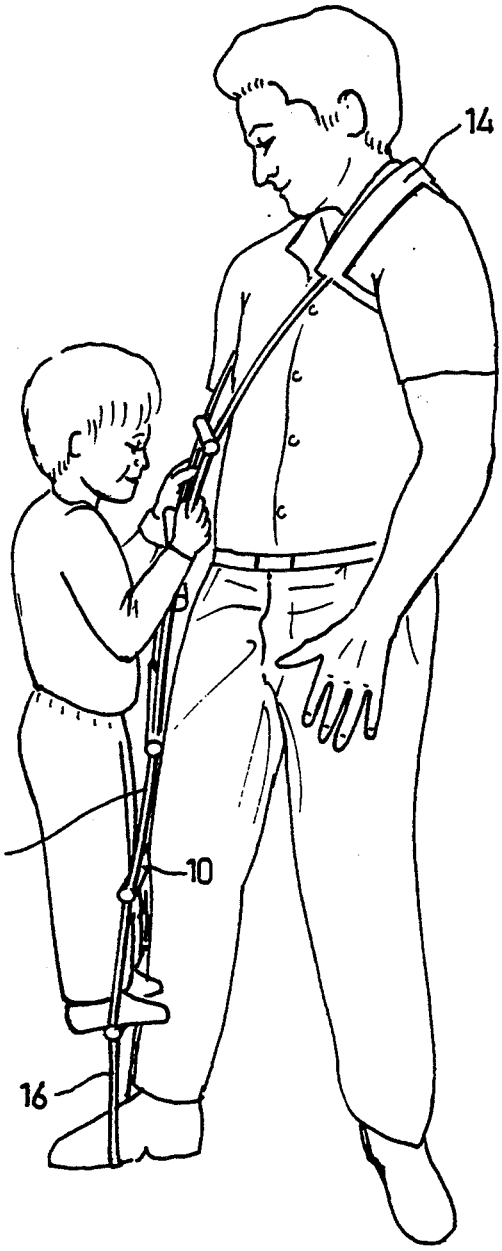
FIG. 2 is a side view of the scene of FIG. 1.
Figure 3:
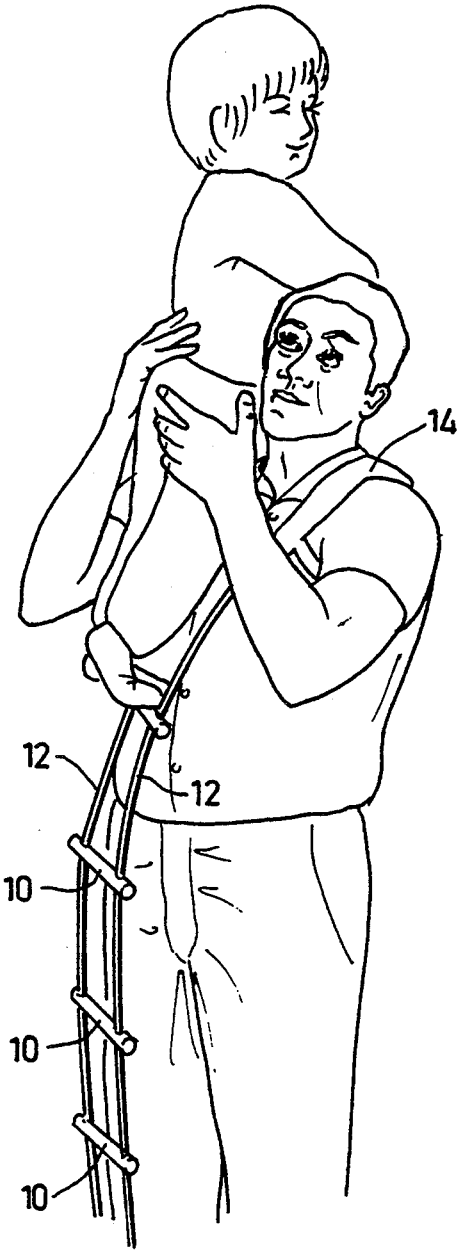
FIG. 3 shows the child standing on the top rung.

Referring now to the drawing, FIGS. 1, 2 and 3 illustrate a general appearance and mode of use of one type of device according to the present invention.

The ladder includes two or more rungs 10, and substantially vertical upright members 12, typically two in number, which serve to connect rungs 10 and form a ladder.

Rungs 10 and upright members 12 may independently be made of any convenient material, including, but not limited to plastic, rope, fabric, cloth, metal or wood. Upright members 12 may be rigid but are preferably flexible so as to allow the ladder to bend to match the contour of the adult's body.

To the top portion of the ladder is connected a top attaching member 14 which serves to facilitate the wearing of the ladder by, or the attachment of the ladder to, the adult. Any convenient means may be used to accomplish this purpose. Typically, this may accomplished through a harness or strap which is able to attach to the adult's neck, shoulders, arms and/or back, preferably to the shoulders and back, so as to comfortably distribute the weigh of the child and the ladder and minimize strain on the adult.

In a preferred embodiment of a device according to the present invention, it is desirable connect to the bottom portion of the ladder a bottom attaching member 16 which member can serve to stabilize the ladder. Any convenient means may be used to accomplish this purpose. Preferably, this may accomplished by using a strap. The adult can put a portion of his foot through the loop in the strap and step down on the ground so that the sole of his show presses the strap firmly to the ground thus immobilizing the strap and stabilizing the ladder by preventing it from swinging uncontrollably as the child climbs or descends.

It is preferable that top attaching member 14 and, most preferable that top attaching member 14 and bottom attaching member 16 be adjustable so as to comfortably accommodate adults of various heights and body builds.

Figure 4:
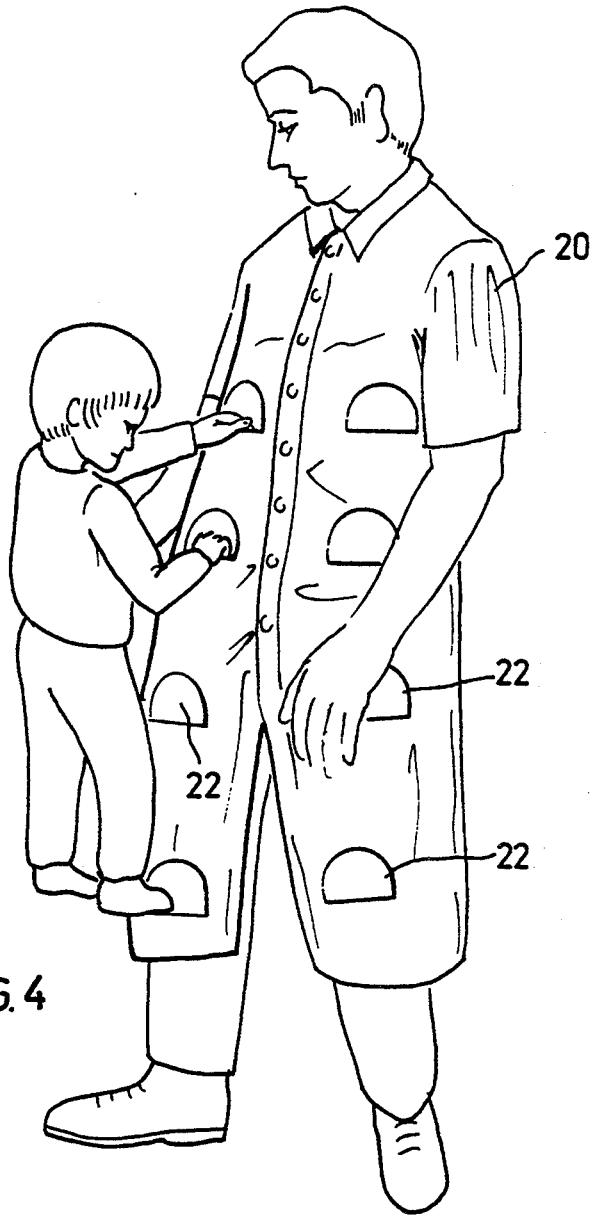
FIG. 4 is a substantially frontal view of an adult wearing a device according to an alternative embodiment of the present invention with a child standing on the lowest hole.

In an alternative embodiment shown in FIG. 4 the device is in the form of an overcoat 20 which features holes 22 along one or both sides of the front of overcoat 20. In use, the child would climb up by insert the front portion of his foot into a hole, using holes 22 in place of the rungs of the previously described embodiments. The edges of holes 22 are preferably reinforced so that they will not tear when the child steps into them.

While the invention has been described with respect to several preferred embodiments, it will be appreciated that many variations, modifications and other applications of the invention may be made.

What is claimed is:

1. A method by which a first person climbs onto a second person, comprising the steps of:

(a) attaching a climbing device to the second person; and (b) climbing by the first person using said climbing device, said device including:

(i) a ladder; and (ii) attaching means connected to said ladder for attaching said ladder to the second person.

2. A method as in claim 1 wherein said attaching means includes means for attaching the top of said ladder to the neck of the second person.

3. A method as in claim 1 wherein said attaching means includes means for attaching the top of said ladder to the shoulders of the second person.

4. A method as in claim 1 wherein said attaching means includes means for attaching the top of said ladder to the arms of the second person.

5. A method as in claim 1 wherein said attaching means includes means for attaching the top of said ladder to the back of the second person.

6. A method as in claim 1 wherein said attaching means includes means for attaching the bottom of said ladder to the foot of the second person.

7. A method as in claim 1 wherein said attaching means includes means for attaching the bottom of said ladder to the leg of the second person.

8. A method as in claim 1 wherein said ladder includes at least two rungs and further includes at least two vertical members connecting said rungs.

9. A method as in claim 7 wherein said vertical members are made of plastic, rope, fabric, cloth, metal or wood.

10. A method as in claim 7 wherein said rungs are made of plastic, rope, fabric, cloth, metal or wood.

11. A method as in claim 1 wherein said attaching means is adjustable.

12. A method by which a first person climbs onto a second person, comprising the steps of:

(a) attaching a climbing device to the second person; and (b) climbing by the first person using said climbing device, said device including:

(i) a stepping means for accommodating the feet of the first person as the first person climbs onto the second person; and (ii) attachment means for attaching said stepping means to the second person.

* * * * *